US007704333B2

(12) United States Patent
Cho et al.

(10) Patent No.: US 7,704,333 B2
(45) **Date of Patent: *Apr. 27, 2010**

(54) AL-CU-MG-AG-MN ALLOY FOR STRUCTURAL APPLICATIONS REQUIRING HIGH STRENGTH AND HIGH DUCTILITY

(75) Inventors: Alex Cho, Charleston, WV (US); Vic Dangerfield, Parkersburg, WV (US); Bernard Bès, Seyssins (FR); Timothy Warner, Voreppe (FR)

(73) Assignees: Alean Rolled Products Ravenswood LLC, Ravensood, WV (US); Alean Rhenalu, Paris (FR)

( * ) Notice: Subject to any disclaimer, the term of this patent is extended or adjusted under 35 U.S.C. 154(b) by 414 days.

This patent is subject to a terminal disclaimer.

(21) Appl. No.: 11/625,113

(22) Filed: Jan. 19, 2007

(65) Prior Publication Data

US 2007/0131313 A1 Jun. 14, 2007

Related U.S. Application Data

(63) Continuation of application No. 10/853,711, filed on May 26, 2004, now Pat. No. 7,229,508.

(60) Provisional application No. 60/473,538, filed on May 28, 2003.

(51) Int. Cl.
*C22C 21/12* (2006.01)

(52) U.S. Cl. ..... 148/417; 420/533; 420/539

(58) Field of Classification Search ..... 148/417, 148/418, 688; 420/533, 539, 553
See application file for complete search history.

(56) References Cited

U.S. PATENT DOCUMENTS

| | | | | |
|---|---|---|---|---|
| 4,772,342 | A | 9/1988 | Polmear | |
| 5,211,910 | A | 5/1993 | Pickens et al. | |
| 5,376,192 | A | 12/1994 | Cassada, III | |
| 5,630,889 | A | 5/1997 | Karabin | |
| 5,685,306 | A | 11/1997 | Davidson | |
| 5,800,927 | A | 9/1998 | Karabin | |
| 5,879,475 | A | 3/1999 | Karabin | |
| 7,229,508 | B2 * | 6/2007 | Cho et al. | 148/417 |
| 7,229,509 | B2 * | 6/2007 | Cho | 148/417 |
| 7,449,073 | B2 | 11/2008 | Lin et al. | |
| 2005/0081965 | A1 | 4/2005 | Benedictus et al. | |

FOREIGN PATENT DOCUMENTS

| | | |
|---|---|---|
| GB | 2 430 937 A | 4/2007 |
| JP | 54010214 | 1/1979 |
| JP | 08252689 | 10/1996 |

* cited by examiner

*Primary Examiner*—Roy King
*Assistant Examiner*—Janelle Morillo
(74) *Attorney, Agent, or Firm*—Baker Donelson Bearman Caldwell & Berkowitz, PC

(57) ABSTRACT

An aluminum alloy having improved strength and ductility, comprising:
Cu 3.5-5.8 wt. %,
Mg 0.2-1.5 wt. %
Mn 0.2-0.5 wt. %
Ag 0.2-0.8 wt. %
Ti 0.02-0.12 wt. % and
optionally one or more selected from the group consisting of Cr 0.1-0.8 wt. %, Hf 0.1-1.0 wt. %, Sc 0.03-0.6 wt. %, and V 0.05-0.15 wt. %,
balance aluminum and incidental elements and impurities, and wherein the alloy is substantially zirconium-free.

24 Claims, 2 Drawing Sheets

Fractography of A sample tested at -65F
(showing ductile fracture mode)

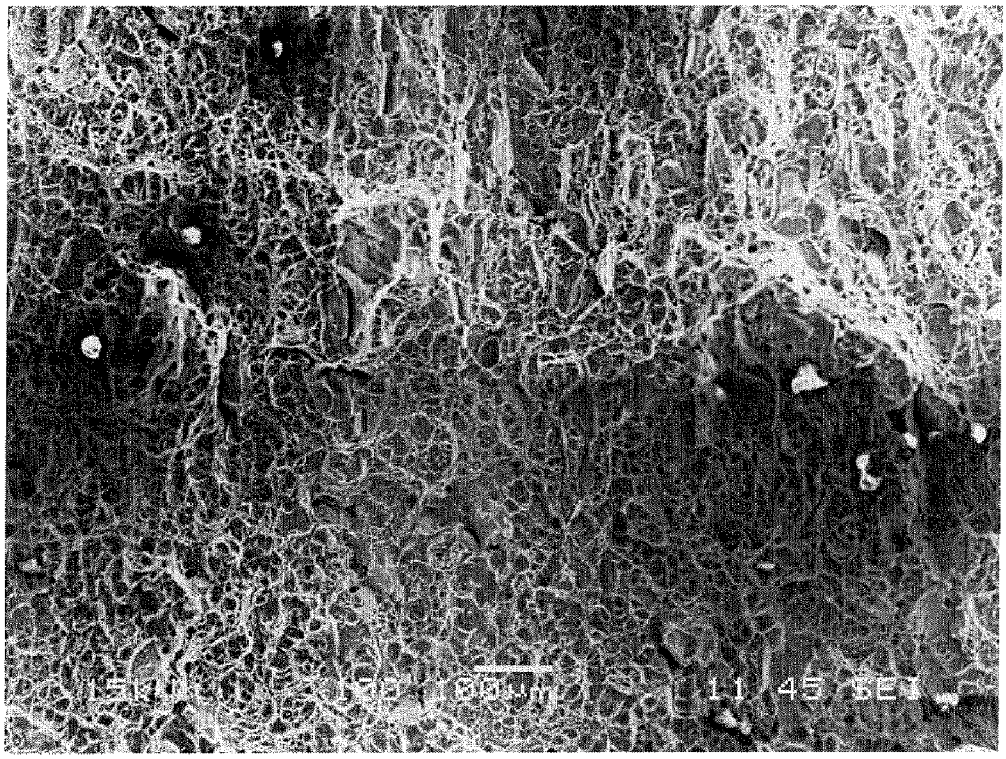
Figure 1. Fractography of A sample tested at -65F
(showing ductile fracture mode)

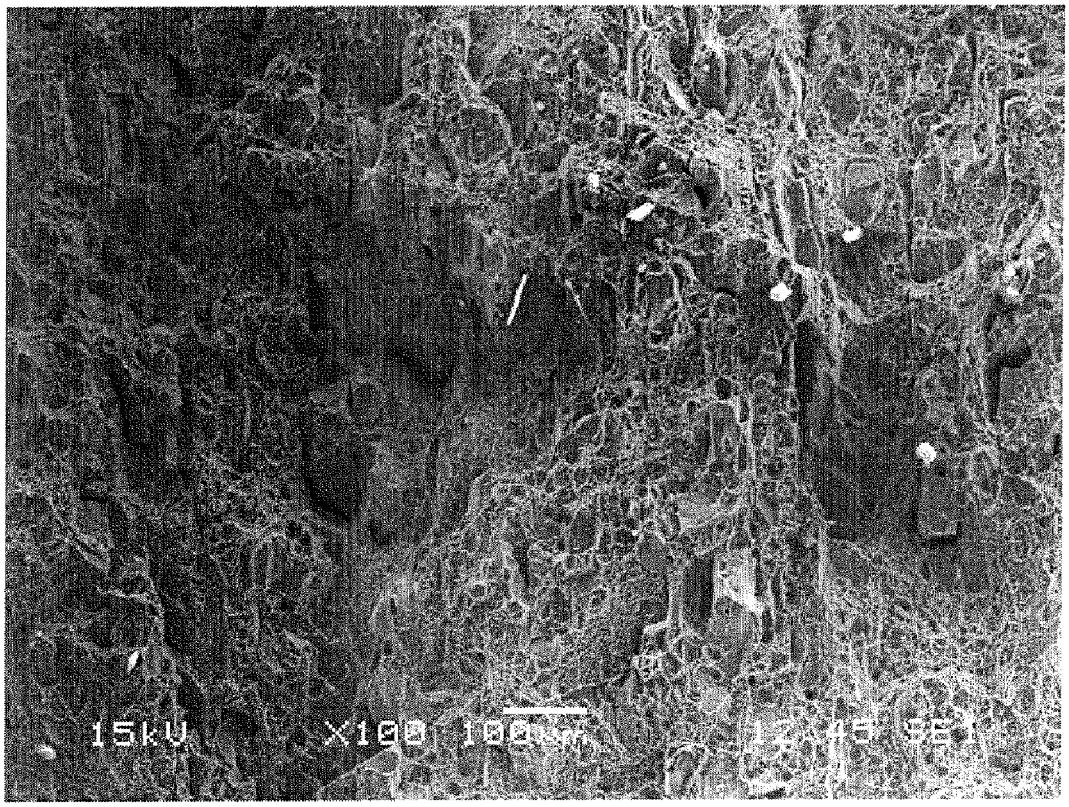
Figure 2. Fractography of B sample tested at -65F
(showing many areas with brittle fracture mode)

AL-CU-MG-AG-MN ALLOY FOR STRUCTURAL APPLICATIONS REQUIRING HIGH STRENGTH AND HIGH DUCTILITY

CROSS REFERENCE TO RELATED APPLICATIONS

This application is a continuation of U.S. application Ser. No. 10/853,711 filed May 26, 2004 now U.S. Pat. No. 7,229,508, which in turn claims priority from provisional application U.S. Ser. No. 60/473,538, filed May 28, 2003, the content of each is incorporated herein by reference in its entirety.

BACKGROUND OF THE INVENTION

1. Field of the Invention

The present invention relates generally to aluminum-copper-magnesium based alloys and products, and more particularly to aluminum-copper-magnesium alloys and products containing silver, including those particularly suitable for aircraft structural applications requiring high strength and ductility as well as high durability and damage tolerance such as fracture toughness and fatigue resistance.

2. Description of Related Art

Aerospace applications generally require a very specific set of properties. High strength alloys are generally desired, but according to the desired intended use, other properties such as high fracture toughness or ductility, as well as good corrosion resistance may also usually be required.

Aluminum alloys containing copper, magnesium and silver are known in the art.

U.S. Pat. No. 4,772,342 describes a wrought aluminum-copper-magnesium-silver alloy including copper in an amount of 5-7 weight (wt.) percent (%), magnesium in an amount of 0.3-0.8 wt. %, silver in an amount of 0.2-1 wt. %, manganese in an amount of 0.3-1.0 wt. %, zirconium in an amount of 0.1-0.25 wt. %, vanadium in an amount of 0.05-0.15 wt. %, silicon less than 0.10 wt. %, and the balance aluminum.

U.S. Pat. No. 5,376,192 discloses a wrought aluminum alloy comprising about 2.5-5.5 wt. % copper, about 0.10-2.3 wt. % magnesium, about 0.1-1% wt. % silver, up to 0.05 wt. % titanium, and the balance aluminum, in which the amount of copper and magnesium together is maintained at less than the solid solubility limit for copper and magnesium in aluminum.

U.S. Pat. Nos. 5,630,889, 5,665,306, 5,800,927, and 5,879,475 disclose substantially vanadium-free aluminum-based alloys including about 4.85-5.3 wt. % copper, about 0.5-1 wt. % magnesium, about 0.4-0.8 wt. % manganese, about 0.2-0.8 wt. % silver, up to about 0.25 wt. % zirconium, up to about 0.1 wt. % silicon, and up to 0.1 wt. % iron, the balance aluminum, incidental elements and impurities. The alloy can be produced for use in extruded, rolled or forged products, and in a preferred embodiment, the alloy contains a Zr level of about 0.15 wt. %.

SUMMARY OF THE INVENTION

An object of the present invention was to provide a high strength, high ductility alloy, comprising copper, magnesium, silver, manganese and optionally titanium, which is substantially free of zirconium. Certain alloys of the present invention are particularly suitable for a wide range of aircraft applications, in particular for fuselage applications, lower wing skin applications, and/or stringers as well as other applications.

In accordance with the present invention, there is provided an aluminum-copper alloy comprising about 3.5-5.8 wt. % copper, 0.1-1.8 wt. % magnesium, 0.2-0.8 wt. % silver, 0.1-0.8 wt. % manganese, as well as 0.02-0.12 wt. % titanium and the balance being aluminum and incidental elements and impurities. These incidental elements impurities can optionally include iron and silicon. Optionally one or more elements selected from the group consisting of chromium, hafnium, scandium and vanadium may be added in an amount of up to 0.8 wt. % for Cr, 1.0 wt. % for Hf. 0.8 wt. % for Sc, and 0.15 wt. % for V, either in addition to, or instead of Ti.

An alloy according to the present invention is advantageously substantially free of zirconium. This means that zirconium is preferably present in an amount of less than or equal to about 0.05 wt. %, which is the conventional impurity level for zirconium.

The inventive alloy can be manufactured and/or treated in any desired manner, such as by forming an extruded, rolled or forged product. The present invention is further directed to methods for the manufacture and use of alloys as well as to products comprising alloys.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

FIG. 1 shows a fracture surface (scanning electron micrograph by secondary electron image mode) of Inventive Sample A according to the present invention after toughness testing at −65F (−53.9° C.). The fractured surface exhibits the ductile fracture mode.

FIG. 2 shows a fracture surface (scanning electron micrograph by secondary electron image mode) of comparative Sample B after toughness testing at −65F (−53.9° C.). The fractured surface exhibits a brittle fracture mode.

DETAILED DESCRIPTION OF A PREFERRED EMBODIMENT

Structural members for aircraft structures, whether they are extruded, rolled and/or forged, usually benefit from enhanced strength. In this perspective, alloys with improved strength, combined with high ductility are particularly suitable for designing structural elements to be used in fuselages as an example. The present invention fulfils a need of the aircraft industry as well as others by providing an aluminum alloy, which comprises certain desired amounts of copper, magnesium, silver, manganese and titanium and/or other grain refining elements such as chromium, hafnium, scandium, or vanadium, and which is also substantially free of zirconium.

In the present invention, it was unexpectedly discovered that the addition of manganese and titanium to substantially zirconium-free Al—Cu—Mg—Ag alloys provides substantial and significantly improved results in terms of ductility, without deteriorating strength. Moreover alloys according to some embodiments of the present invention even show an improvement in strength as well.

"Substantially zirconium free" means a zirconium-content equal to or below about 0.05 wt. %, preferably below about 0.03 wt. %, and still more preferably below about 0.01 wt. %.

The present invention in one embodiment is directed to alloys comprising (i) between 3.5 wt. % and 5.8 wt. % copper, preferably between 3.80 and 5.5 wt. %, and still more preferably between 4.70 and 5.30 wt. %, (ii) between 0.1 wt % and 0.8 wt. % silver, and (iii) between 0.1-1.8 wt. % of magnesium, preferably between 0.2 and 1.5 wt. %, more preferably between 0.2 and 0.8 wt. %, and still more preferably between 0.3 and 0.6 wt. %.

It was unexpectedly discovered that additions of manganese and titanium and/or other grain refining elements according to some embodiments of the present invention enhanced the strength and ductility of such Al—Cu—Mg—Ag alloys. Preferably manganese is included in an amount of about 0.1 to 0.8 wt. %, and particularly preferably in an amount of about 0.3 to 0.5 wt. %. Titanium is advantageously included in an amount of about 0.02 to 0.12 wt. %, preferably 0.03 to 0.09 wt. %, and more preferably between 0.03 and 0.07 wt. %. Other optional grain refining elements if included can comprise, for example, Cr in an amount of about 0.1 to 0.8 wt. %, Sc in an amount of about 0.03 to 0.6 wt. %, Hf in an amount of 0.1 to about 1.0 wt. % and/or V in an amount of about 0.05 to 0.15 wt. %, A particularly advantageous embodiment of the present invention is a sheet or plate comprising 4.70-5.20 wt. % Cu, 0.2-0.6 wt. % Mg, 0.2-0.5 wt. % Mn, 0.2-0.5 wt % Ag, 0.03-0.09 (and preferably 0.03-0.07) wt. % Ti, and less than 0.03, preferably less than 0.02 and still more preferably less than 0.01 wt. % Zr. This sheet or plate product is particularly suitable for the manufacture of fuselage skin for an aircraft or other similar or dissimilar article. It can also be used, for example for the manufacture of wing skin for an aircraft or the like. A product of the present invention exhibits unexpectedly improved fracture toughness and fatigue crack propagation rate, as well as a good corrosion resistance and mechanical strength after solution heat treatment, quenching, stretching and aging.

A sheet or plate product of the present invention preferably has a thickness ranging from about 2 mm to about 10 mm, and preferably has a fracture toughness $K_c$, determined at room temperature from the R-curve measure on a 406 mm wide CCT panel in the L-T orientation, which equals or exceeds about 170 MPa√m, and preferably exceeds 180 or even 190 MPa√m. For the same sheet or plate product, the fatigue crack propagation rate (determined according to ASTM E 647 on a CCT-specimen (width 400 mm) at constant amplitude (R=0.1) is generally equal to or below about 3.0 $10^{-2}$ mm/cycle at ΔK=60 MPa√m (measured on a specimen with a thickness of 6.3 mm (taken at mid-thickness) or the full product thickness, whichever smaller). As used herein, the terms "sheet" and "plate" are interchangeable.

Sheet and plate in the thickness range from about 5 mm to about 25 mm advantageously have an elongation of at least about 13.5% and a UTS of at least about 69.5 ksi (479.2 MPa), and/or an elongation of at least about 15.5% and a UTS of at least about 69 ksi (475.7 MPa). As the product gauge decreases, elongation and UTS values of the product may decrease slightly. The instant UTS and elongation properties are deduced from a tensile test in the L-direction as is commonly utilized in the industry.

Tensile test results from plate product of 25.4 mm gauge (1 inch) demonstrated similar improvement of an inventive alloy over prior art alloys (see Table 2).

These results from the two substantially different gauge products demonstrated that the inventive alloy is superior to alloys considered to be the closest prior art. The material performance of the inventive alloy is therefore expected to be superior to that of other prior art alloys for a myriad and broad range of wrought product forms and gauges.

Among the optional elements Cr, Hf, Sc and V, the addition of scandium in the range of 0.03-0.25 wt. % is particularly preferred in some embodiments.

The following examples are provided to illustrate the invention but the invention is not to be considered as limited thereto. In these examples and throughout this specification, parts are by weight unless otherwise indicated. Also, compositions may include normal and/or inevitable impurities, such as silicon, iron and zinc.

EXAMPLE 1

Large commercial scale ingots were cast with 16 inch (406.4 mm) thick by 45 inch (1143 mm) wide cross section for the invented alloy A and two other alloys B and C. These ingots were homogenized at a temperature of 970° F. (521° C.) for 24 hours. From these ingots, two different gauge plate products, 1.00 inch gauge (25.4 mm) and 0.29 inch gauge (7.4 mm), were produced in accordance with conventional methods.

A) Plate Product; 1 Inch (25.4 mm) Gauge

A portion of the homogenized ingots were hot rolled to 1 inch (25.4 mm) gauge plate to evaluate the invented alloy A and the two other alloys, alloy B and alloy C.

The process used was:

hot rolling said ingot at a temperature range of 700 to 900° F. (371° C. to 482.2° C.), until it forms a plate about 1 inch (25.4 mm) thick;

solution heat treating said product for 1 hour at 980° F. (526.7° C.);

quenching the product in cold water;

stretching the product to nominal 6 percent permanent set;

artificially aging the product.

The aging treatment is usually of a high importance, as it aims at obtaining a good corrosion behavior, without losing too much strength. Different aging practices tested for all three alloys were the following:

a) 12 hours at 320° F. (160° C.)

b) 18 hours at 320° F. (160° C.)

c) 24 hours at 320° F. (160° C.).

The final thickness of all three alloy samples was 1 inch (nominal) (25.4 mm).

The chemical compositions in weight percent of alloy A, B and C samples are given in Table 1 below, and the static mechanical properties measured on the 1 inch (25.4 mm) plate samples are given in table 2.

TABLE 1

| | Compositions of cast alloys A, B and C (in wt. %) | | | | | | | |
|---|---|---|---|---|---|---|---|---|
| | Si | Fe | Cu | Mg | Ag | Ti | Mn | Zr |
| Alloy A sample (according to the invention) | 0.03 | 0.04 | 4.9 | 0.46 | 0.38 | 0.09 | 0.32 | 0.002 |

TABLE 1-continued

| Compositions of cast alloys A, B and C (in wt. %) | | | | | | | | |
|---|---|---|---|---|---|---|---|---|
| | Si | Fe | Cu | Mg | Ag | Ti | Mn | Zr |
| Alloy B sample (AlCuMgAg with Zr & no Mn) | 0.03 | 0.06 | 4.81 | 0.46 | 0.39 | 0.02 | 0.01 | 0.14 |
| Alloy C sample (AlCuMgAg, with Ti, no Mn) | 0.03 | 0.05 | 4.88 | 0.46 | 0.36 | 0.11 | 0.01 | 0.001 |

TABLE 2

| Mechanical properties of 1 inch (25.4 mm) gauge plate from alloy A, B and C products in L direction | | | | |
|---|---|---|---|---|
| alloy | Aging practice | UTS Ks i(MPa) | TYS Ksi (MPa) | E(%) |
| Alloy A | 12 hours | 71.5 (494) | 67.7 (468) | 15.0 |
| | at 320° F. (160° C.) | 71.5 (494) | 67.8 (468) | 16.0 |
| | 18 hours | 72 (498) | 68.2 (471) | 14.5 |
| | at 320° F. (160° C.) | 72 (498) | 68.5 (473) | 14.0 |
| | 24 hours | 72.3 (500) | 68.3 (472) | 14.0 |
| | at 320° F. (160° C.) | 72.1 (498) | 68.1 (471) | 15.5 |
| Alloy B | 12 hours | 70.1 (484) | 65.9 (455) | 13.5 |
| | at 320° F. (160° C.) | 70.2 (485) | 66.1 (457) | 13.5 |
| | 18 hours | 70.7 (489) | 66.7 (461) | 12.5 |
| | at 320° F. (160° C.) | 70.8 (489) | 66.7 (461) | 12.0 |
| | 24 hours | 70.9 (490) | 66.6 (460) | 12.5 |
| | at 320° F. (160° C.) | 70.8 (489) | 66.6 (460) | 13.5 |
| Alloy C | 12 hours | 71.0 (491) | 66.2 (457) | 13.0 |
| | at 320° F. (160° C.) | 70.8 (489) | 66.1 (457) | 13.0 |
| | 18 hours | 71.6 (495) | 67.0 (463) | 11.5 |
| | at 320° F. (160° C.) | 71.7 (495) | 67.1 (464) | 11.0 |
| | 24 hours | 72.0 (498) | 67.0 (463) | 10.0 |
| | at 320° F. (160° C.) | 71.9 (497) | 67.0 (463) | 10.0 |

Alloy A according to the invention exhibits better strength and elongation than the other alloys B and C, which do not contain Mn and/or Ti. The present invention further shows a significant improvement of UTS (ultimate tensile strength), TYS (tensile yield strength) and E (elongation) at peak strength.

B) Thin Plate Product; 0.29 Inch (7.4 mm) Gauge

To evaluate the material performance in thin gauge wrought product, a portion of the three homogenized ingots described above were hot rolled to 0.29 inch (7.4 mm) gauge plate for the inventing alloy A and the two other alloys, alloy B and alloy C.

The process used was as follows:

hot rolling said ingot at a temperature range of 700 to 900° F. (371° C. to 482.2° C.), until it forms a plate about 0.29 inches (7.4 mm) thick;

solution heat treating said product for 30 minutes at 980° F. (526.7° C.);

quenching the product in cold water;

stretching the product to 3 percent permanent set;

Artificially aging the product.

Different aging practices tested for all three samples were the following:

a) 10 hours at 350° F. (176.7° C.)

b) 12 hours at 350° F. (176.7° C.)

c) 16 hours at 350° F. (176.7° C.)

d) 24 hours at 320° F. (160° C.)

the final thickness of thin plate from all three alloy samples was 0.29 inches (nominal) (7.4 mm).

The static mechanical properties measured on 0.29 inch (7.4 mm gauge) sheet samples are given in table 3.

TABLE 3

| Mechanical properties of 0.29 inch (7.4 mm) thin plate from alloy A, B and C in L direction | | | | |
|---|---|---|---|---|
| | Aging practice | UTS (ksi) UTS (MPa) | TYS (ksi) TYS (MPa) | E (%) |
| Sample A (inventive alloy) | 10 hours at 350° F. (176.7° C.) | 70.8 488.2 | 66.1 455.7 | 14 |
| | 24 hours at 320° F. (160° C.) | 70.7 487.5 | 66.5 458.5 | 16 |
| Sample B | 10 hours at 350° F. (176.7° C.) | 69 475.7 | 63.9 440.6 | 11.5 |
| | 24 hours at 320° F. (160° C.) | 69.2 477.1 | 64.5 444.7 | 13 |
| Sample C | 10 hours at 350° F. (176.7° C.) | 69.6 479.9 | 64.3 443.3 | 8 |
| | 24 hours at 320° F. (160° C.) | 69.9 481.9 | 61.6 424.7 | 11 |

Again, Alloy A according to the invention exhibits better strength and elongation than the other alloys B and C, which do not contain Mn and/or Ti. The present invention further shows a significant improvement of UTS (ultimate tensile strength), TYS (tensile yield strength) and E (elongation) at peak strength.

Additional fracture toughness and fatigue life testing were conducted on sample of alloys A and B sample. The test results are listed in Table 4. The inventive alloy A sample shows higher fracture toughness values tested at room temperature as well as at −65° F. (−53.9° C.).

It should be noted that the improved $K_C$ and $K_{app}$ values of alloy A sample over those of alloy B sample are most pronounced when tested at −65° F. (-53.9° C.) which is the service environment for aircraft flying at high altitude.

Such attractive material characteristics of Alloy A sample is also evident by Scanning Electron Microscopy examination on the fractured surfaces of these fracture test specimens. The fractography of Alloy A sample in FIG. 1 shows the fractured surfaces with ductile fracture mode while that of Alloy B sample in FIG. 2 shows many areas of brittle fracture mode.

Superior resistance to fatigue failure is one of the important attributes of products for aerospace structural applications. As shown in Table 5, Alloy A sample demonstrates higher number of fatigue cycles to failure in both of two different testing methods.

TABLE 4

Fracture Toughness of alloy A and B products in L–T direction (tests are conducted per ASTM E561 and ASTM B646)

| | Aging practice | Test method | Test direction | Test result (ksi*✓in) (MPa√m) |
|---|---|---|---|---|
| Sample A (inventive alloy) | 10 hours at 350° F. (176.7° C.) | $K_C$ (1)(2) | L–T | 171 (187.9) |
| | | $K_{app}$ (1)(2) | L–T | 118.8 (130.5) |
| | | $K_C$ at −65° F. (1)(2) | L–T | 173.6 (190.8) |
| | | $K_{app}$ at −65° F. (1)(2) | L–T | 116.0 (127.5) |
| Sample B | 10 hours at 350° F. (176.7° C.) | $K_C$ (1)(2) | L–T | 161.3 (177.2) |
| | | $K_{app}$ (1)(2) | L–T | 109.9 (120.8) |
| | | $K_C$ at −65° F. (1)(2) | L–T | 133.7 (146.9) |
| | | $K_{app}$ at −65° F. (1)(2) | L–T | 94.5 (103.8) |

Note:
(1) tested full thickness of approximately 0.28 inch (7.1 mm).
(2) Test specimen width = 16 inch (406.4 mm) with 4 inch (101.6 mm) wide center notch, fatigue pre cracked.

TABLE 5

Fatigue Test of alloy A and B products in L direction (tests are conducted per ASTM E466)

| | Aging practice | Test method | Test direction | Test result (cycles to failure) |
|---|---|---|---|---|
| Sample A (inventive alloy) | 10 hours at 350° F. (176.7° C.) | Notched (3) | L | 151,059 |
| | | Double open hole (4) | L | 116,088 |
| Sample B | 10 hours at 350° F. (176.7° C.) | Notched (3) | L | 103,798 |
| | | Double open hole (4) | L | 89,354 |

Note:
(3) Specimen thickness = 0.15 inch (3.8 mm), R = 0.1, Kt = 1.2, max stress = 45 ksi (310.3 MPa), frequency = 15 hz
(4) Specimen thickness = 0.2 inch (5.1 mm), R = 0.1, max stress = 24 ksi (165.5 MPa), frequency = 15 hz

EXAMPLE 2

Rolling ingots were cast from an alloy with the composition (in weight percent) as given in Table 6.

TABLE 6

Composition of cast alloys S and P

| | Si | Fe | Cu | Mn | Mg | Cr | Ti | Zr | Ag |
|---|---|---|---|---|---|---|---|---|---|
| Sample S | <0.06 | 0.06 | 4.95 | 0.26 | 0.45 | <0.001 | 0.050 | 0.0012 | 0.34 |
| Sample P | <0.06 | 0.06 | 4.93 | 0.20 | 0.43 | <0.001 | 0.021 | 0.091 | 0.34 |

The scalped ingots were heated to 500° C. and hot rolled with an entrance temperature of 480° C. on a reversible hot rolling mill until a thickness of 20 mm was reached, followed by hot rolling on a tandem mill until a thickness of 4.5 mm was reached. The strip was coiled at a metal temperature of about 280° C. The coil was then cold-rolled without intermediate annealing to a thickness of 3.2 mm.

Solution heat treatment was performed at 530° C. during 40 minutes, followed by quenching in cold water (water temperature comprised between 18 and 23° C.).

Stretching was performed with a permanent set of about 2%.

The aging practice for T8 samples was 16 hours at 175° C.

Mechanical properties of sheet samples of alloys S and P in T3 and T8 tempers are given in Table 7.

TABLE 7

Mechanical properties of alloys S and P products in L and LT direction, in MPa and ksi units

| | | T3 temper | | | T8 temper | | |
|---|---|---|---|---|---|---|---|
| sample | | UTS (MPa) | TYS (MPa) | E % | UTS (MPa) | TYS (MPa) | E % |
| S | L | | | | 478 | 444 | 12.9 |
| | LT | 411 | 268 | 23 | 475 | 430 | 12.9 |
| P | L | | | | 473 | 439 | 12.3 |
| | LT | 413 | 273 | 22.5 | 472 | 425 | 12.0 |

| | | T3 temper | | | T8 temper | | |
|---|---|---|---|---|---|---|---|
| sample | | UTS (ksi) | TYS (ksi) | E % | UTS (ksi) | TYS (ksi) | E % |
| S | L | | | | 69.4 | 64.4 | 12.9 |
| | LT | 59.7 | 38.9 | 23 | 68.9 | 62.4 | 12.9 |
| P | L | | | | 68.7 | 63.7 | 12.3 |
| | LT | 59.9 | 39.6 | 22.5 | 68.5 | 61.7 | 12.0 |

Fracture toughness was calculated from the R-curves determined on CCT-type test pieces of a width of 760 mm with a ratio of crack length a/width of test piece W of 0.33. Table 8 summarized the $K_C$ and $K_{app}$ values calculated from the R curve measurement for the test piece used in the test (W=760 mm) as well as $K_c$ and $K_{app}$ values back-calculated for a test piece with W=406 mm. As those skilled in the art will know, a calculation of $K_{app}$ and $K_c$ of a narrower panel from the data of a wider panel is in general reliable, whereas the opposite calculation is fraught with uncertainties.

TABLE 8

Fracture toughness of alloys S and P products

| Sample | Orientation | Panel width | $K_{app}$ MPa√m | $K_C$ MPa√m | $K_{app}$ ksi√in | $K_C$ ksi√in |
|---|---|---|---|---|---|---|
| P | L–T | Calculated for W = 406 mm panel | 118.1 | 163.9 | 107.4 | 149.0 |
| S | L–T | Calculated for W = 406 mm panel | 121 | 178.7 | 110.0 | 162.5 |
| P | L–T | For W = 760 mm panel | 144.3 | 189.9 | 131.2 | 172.6 |
| S | L–T | For W = 760 mm panel | 154.8 | 221.3 | 140.7 | 201.2 |

It can be seen that sample S (without zirconium) has significantly higher $K_C$ values that the zirconium-containing sample P.

Fatigue crack propagation rates were determined according to ASTM E 647 at constant amplitude (R=0.1) using CCT-type test pieces with a with of 400 mm. The results are shown in table 9.

TABLE 9

Fatigue crack propagation rate of sheet products in alloys S and P

| | Sample P | | Sample S | |
|---|---|---|---|---|
| ΔK [MPa√m] | L–T da/dn [mm/cycles] | T–L da/dn [mm/cycles] | L–T da/dn [mm/cycles] | T–L da/dn [mm/cycles] |
| 10 | 1.64E−04 | $1.24^{E}$−04 | 1.38E−04 | 1.37E−04 |
| 15 | 3.50E−04 | $3.93^{E}$−04 | 4.10E−04 | 3.80E−04 |
| 20 | 7.36E−04 | $8.02^{E}$−04 | 7.13E−04 | 8.33E−04 |
| 25 | 1.30E−03 | $1.57^{E}$−03 | 1.27E−03 | 1.44E−03 |
| 30 | 2.52E−03 | $2.88^{E}$−03 | 2.43E−03 | 2.80E−03 |
| 35 | 4.21E−03 | $5.29^{E}$−03 | 3.93E−03 | 4.37E−03 |
| 40 | 6.29E−03 | $8.67^{E}$−03 | 6.03E−03 | 7.60E−03 |
| 50 | 1.50E−02 | $2.03^{E}$−02 | 1.22E−02 | 1.58E−02 |
| 60 | 3.50E−02 | | 2.72E−02 | |

Exfoliation corrosion was determined by using the EXCO test (ASTM G34) on sheet samples in the T8 temper. Both samples P and S were rated EA.

Intercrystalline corrosion was determined according to ASTM B 110 on sheet samples in the T8 temper. Results are summarized on table 10. As illustrated in table 9, sample S shows generally shallower corrosive attack, and specifically lower maximum depths of intergranular attack than sample P. The total number of corrosion sites observed in sample S was nevertheless greater. It should be noted that the impact of IGC sensitivity on in service properties is generally considered to be related to the role of corroded sites as potential sites for fatigue initiation. In this context, the shallower attack observed on sample S would be considered advantageous.

TABLE 10

Intercrystalline corrosion

| | Face 1 | | Face 2 | |
|---|---|---|---|---|
| Sample | Type of corrosion | Maximum depth (μm) | Type de corrosion | Maximum depth (μm) |
| P | Intergranular (I): 10 | 108 | Intergranular (I): 13 | 98 |
| | Pitting (P): 12 | 108 | Pitting (P): 16 | 83 |
| | Slight intergranular: 9 | 127 | Slight intergranular: 8 | 118 |
| | Mean value | 114 | Mean value | 99 |
| S | Intergranular (I): 32 | 88 | Intergranular (I): 13 | 74 |
| | Pitting (P): 4 | 39 | Pitting (P): 5 | 64 |
| | Slight intergranular: 3 | 88 | Slight intergranular: 5 | 74 |
| | Mean value | 71 | Mean value | 70 |

Stress corrosion testing was performed under a stress of 250 MPa, and no failure was observed after 30 days (when the test was discontinued). Under these conditions, no difference in stress corrosion was found between samples P and S.

Additional advantages, features and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

What is claimed is:

1. An aluminum alloy wrought product having improved strength and ductility, consisting essentially of:

a) Cu 3.8-5.2 wt. %,
Mg 0.2-0.6 wt. %
Mn 0.2-0.5 wt. %
Ag 0.2-0.5 wt. %
Ti 0.02-0.12 wt. % and optionally one or more selected from the group consisting of Cr 0.1-0.8 wt. %, Hf 0.1-1.0 wt. %, Sc 0.03-0.6 wt. %, and V 0.05-0.15 wt. %, b) balance aluminum and normal and/or inevitable elements and impurities, and wherein said alloy is substantially zirconium-free.

2. An aluminum alloy according to claim 1, comprising Ti 0.05-0.12 wt. %.

3. An aluminum alloy according to claim 1, comprising Sc 0.03-0.25 wt. %.

4. An aluminum alloy according to claim 1, comprising Hf 0.1-1.0 wt. %.

5. An aluminum alloy according to claim 1, comprising V 0.05-0.15 wt. %.

6. An aluminum alloy according to claim 1, comprising Cr 0.1-0.8 wt. %.

7. An aluminum alloy wrought product having improved strength and ductility, consisting essentially of:

a) Cu 4.7-5.3 wt. %,
Mg 0.2-0.6 wt. %
Mn 0.2-0.5 wt. %
Ag 0.2-0.5 wt. %
Ti 0.05-0.12 wt. % and optionally one or more selected from the group consisting of Cr 0.1-0.8 wt. %, Hf 0.1-1.0 wt. %, Sc 0.05-0.6 wt. %, and V 0.05-0.15 wt. %.

b) balance aluminum and normal and/or inevitable elements and impurities, and wherein said alloy is substantially zirconium-free.

8. An aluminum alloy according to claim 1, wherein Cu 4.70-5.20 wt. %.

9. An aluminum alloy according to claim 7, wherein Cu 4.70-5.20 wt. %.

10. An aluminum alloy according to claim 1, wherein Zr is less than 0.03 wt. %.

11. An aluminum alloy according to claim 7, wherein Zr is less than 0.03 wt. %.

12. An aluminum alloy according to claim 1, wherein Zr is less than 0.01 wt. %.

13. An aluminum alloy according to claim 10, wherein Zr is less than 0.01 wt. %.

14. An aluminum alloy according to claim 1, which has been solution heat treated, quenched, stress relieved and/or artificially aged.

15. An aluminum alloy of claim 8 that has been formed into a sheet product with a thickness comprised between about 5 and 25 mm having at least one mechanical property (L-direction) selected from the group consisting of a) an elongation of at least about 13.5% and a UTS of at least about 69.5 ksi (479.2 MPa) and b) an elongation of at least about 15.5% and a UTS of at least about 69 ksi (475.7 MPa).

16. A structural member suitable for use in aircraft construction comprising an aluminum alloy according to claim 1.

17. A wrought product comprising an aluminum alloy according to claim 1.

18. A method for producing an aircraft structural member comprising forming an alloy according to claim 1 into said structural member.

19. A sheet comprising an aluminum alloy that is substantially free of zirconium according to claim 1, said sheet having a thickness ranging from about 2 mm to about 10 mm, and a fracture toughness $K_c$, determined at room temperature from the R-curve measure on a 406 mm wide CCT panel in the L-T orientation, which equals or exceeds about 170 Mpa√m, and the fatigue crack propagation rate determined according to ASTM E 647 on a CCT-specimen having a width of 400 mm, at constant amplitude R=0.1 that is equal to or below about 3.0 $10^{-2}$ mm/cycle at $\Delta K$=60 Mpa√m.

20. A sheet comprising an aluminum alloy that is substantially free of zirconium according to claim 1, said sheet having a thickness ranging from about 5 mm to about 25 mm and an elongation of at least about 13.5% and a UTS of at least about 69.5 ksi (479.2 MPa), and/or an elongation of at least about 15.5% and a UTS of at least about 69 ksi (475.7 MPa).

21. A wrought product comprising a sheet according to claim 20.

22. An aircraft structural member comprising a sheet according to claim 20.

23. A wrought product comprising a sheet according to claim 19.

24. An aircraft structural member comprising a sheet according to claim 19.

* * * * *

UNITED STATES PATENT AND TRADEMARK OFFICE

CERTIFICATE OF CORRECTION

PATENT NO. : 7,704,333 B2
APPLICATION NO. : 11/625113
DATED : April 27, 2010
INVENTOR(S) : Alex Cho et al.

It is certified that error appears in the above-identified patent and that said Letters Patent is hereby corrected as shown below:

Title Page; should read:

In section (73) Assignees' names:

ALCAN ROLLED PRODUCTS RAVENSWOOD LLC
ALCAN RHENALU

Signed and Sealed this

Third Day of August, 2010

David J. Kappos

David J. Kappos
*Director of the United States Patent and Trademark Office*